US007594769B2

(12) United States Patent
Wangblad

(10) Patent No.: US 7,594,769 B2
(45) Date of Patent: Sep. 29, 2009

(54) METHOD AND SYSTEM FOR PROTECTING A PRINT HEAD IN A CONTENT APPLICATOR AND READER

(75) Inventor: Lars Wangblad, Marstrand (SE)

(73) Assignee: Intermec IP Corp., Everett, WA (US)

( * ) Notice: Subject to any disclaimer, the term of this patent is extended or adjusted under 35 U.S.C. 154(b) by 536 days.

(21) Appl. No.: 11/542,661

(22) Filed: Oct. 3, 2006

(65) Prior Publication Data

US 2007/0103516 A1 May 10, 2007

Related U.S. Application Data

(60) Provisional application No. 60/723,168, filed on Oct. 3, 2005.

(51) Int. Cl.
*B41J 7/18* (2006.01)

(52) U.S. Cl. ..... 400/120.01; 347/200; 347/201

(58) Field of Classification Search ..... 347/64, 347/203
See application file for complete search history.

(56) References Cited

U.S. PATENT DOCUMENTS 5,791,793 A 8/1998 Nagahata
6,791,591 B2 9/2004 Conwell et al.

FOREIGN PATENT DOCUMENTS

JP 11138941 5/1999

*Primary Examiner*—Julian D Huffman
*Assistant Examiner*—Alexander C Witkowski
(74) *Attorney, Agent, or Firm*—Seed IP Law Group PLLC

(57) ABSTRACT

A content applicator for selectively processing media received by the content applicator. The content applicator includes a print station having a print station protector subsystem. When the print station is in a print offline mode, the print station protector subsystem protects at least one component of the print station from degradation caused by media being received by the print station while the print station is in print offline mode.

20 Claims, 6 Drawing Sheets

METHOD AND SYSTEM FOR PROTECTING A PRINT HEAD IN A CONTENT APPLICATOR AND READER

CROSS-REFERENCE TO RELATED APPLICATION

This application claims the benefit under 35 U.S.C. § 119 (e) of U.S. Provisional Patent Application No. 60/723,168 filed Oct. 3, 2005.

BACKGROUND OF THE INVENTION

1. Field of the Invention

This disclosure generally relates to printers, and more particularly, protecting a print head in a printer.

2. Description of the Related Art

Typically, labels are comprised of a label face stock, which may be suitable for printing, a release liner, and an adhesive layer sandwiched between the label face stock and the release liner. A label may also include a radio frequency identification (RFID) tag or device that can carry information.

An applicator having a print engine may be used to print to the face stock of a label. Some applicators include an RFID reader/writer for reading or writing to RFID devices included with labels. Frequently, a thermal print head is used to print to the face stock. Typically, the thermal print head engages the label while printing to the label, and the engagement of the thermal print head with the label causes wear and tear to the thermal print head, for example, to one or more resistive elements of the thermal print head. In addition, the print head of an applicator having both a print head and an RFID reader/writer can be subjected to wear and tear by the applicator processing a label even when the print head does not print to the label.

There is a need in such applicators to avoid such degradation when the applicator is processing a medium while not printing.

BRIEF SUMMARY OF THE INVENTION

In one aspect, a content applicator comprises a printer head, and a protective member selectively interposable between the print head and a media transport path for media processed by the content applicator.

In another aspect, a method of using a content applicator comprises receiving a medium at a content applicator having a print head; interposing a protective member between the print head and a media transport path; feeding the medium through the print station; and writing to at least one radio frequency identification device carried by the medium.

In yet another aspect, a content applicator comprises a print station including a thermal print head having at least one resistive element, and a platen opposed across a media transport path from the at least one resistive element, the print station configured to be switched between a print station online mode and a print station offline mode; and a print station protector selectively positionable with respect to the print head to protect the at least one resistive element of the print station from degradation cause by the print station receiving a medium when the print station is in the print station offline mode.

BRIEF DESCRIPTION OF THE SEVERAL VIEWS OF THE DRAWING(S)

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE INVENTION

Figure 1:
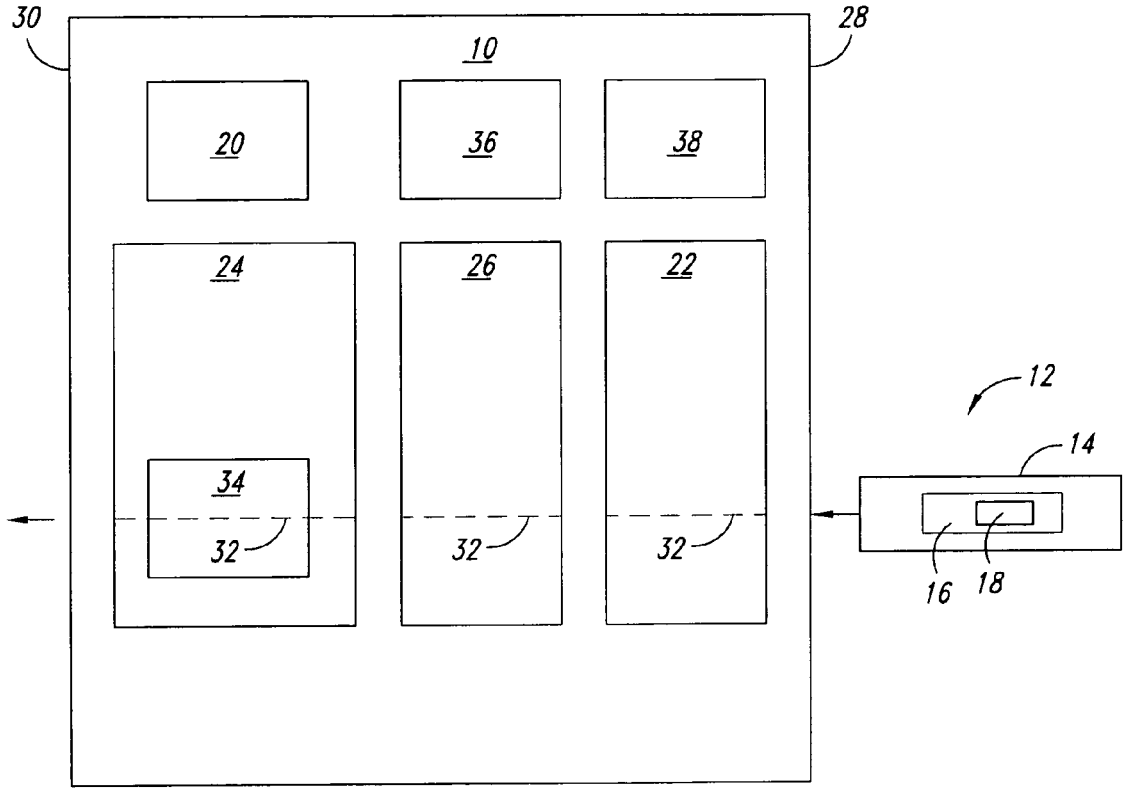
FIG. 1 is a functional block diagram of a content applicator and reader according to one illustrated embodiment.

FIG. 1 shows a Content-Applicator/Reader (CA/R) 10 and a medium 12. The medium 12 has a print surface 14, which is suitable for having content printed thereon, and an RFID device 16, which has a memory 18 in which information may be stored. Sometimes information is stored in the memory 18 prior to the medium 12 being provided to the CA/R 10, and other times information is not stored in the memory 18 prior to the medium 12 being provided to the CA/R 10. Similarly, sometimes content is pre-printed on the print surface 14 prior to the medium 12 being provided to the CA/R 10, and other times content is not pre-printed on the print surface 14 prior to the medium 12 being provided to the CA/R 10. Sometimes, the medium 12 may include the print surface 14 but not include the RFID device 16, and other times the medium 12 may include the RFID device 16 but not include the print surface 14. Typically, the medium 12 includes both the print surface 14 and the RFID device 16. For the sake of clarity, the medium 12 is discussed below as having both the print surface 14 and the RFID device 16. In addition, it should be noted that the medium 12 may be a discrete medium such as, but not limited to, a sheet or a label, or the medium 12 may be a continuous medium such as, but not limited to, a web or a roll of labels.

The CA/R 10 includes a control subsystem 20, an RFID station subsystem 22 and a print station subsystem 24. A medium transport assembly 26 interposes the RFID station subsystem 22 and the print station subsystem 24. The medium transport assembly 26 may include rollers, spindles, platen, belts, and pathways for passing, conveying, or transporting the medium 12 from the RFID station subsystem 22 to the print station subsystem 24. In some embodiments, the medium transport assembly 26 may pass, convey, or transport the medium 12 from the print station subsystem 24 to the RFID station subsystem 22.

The medium 12 is received at an input side 28 of the CA/R 10, and, after processing, the medium 12 exits the CA/R 10 at an output side 30. During processing, the medium 12 passes through the RFID station subsystem 22 and the print station subsystem 24 along a medium transport path 32. The medium transport path 32 is defined by slots, openings, rollers, spindles, belts, platen, platen roller, in the RFID station subsystem 22, print station subsystem 24, and medium transport assembly 26. It should be noted that the CA/R 10 might include other medium pathways, which may be used to, among other things, clear medium from the CA/R 10 when there is medium jammed in the CA/R 10. However, in some embodiments, the medium transport path 32 is the one, and only, pathway through which the medium 12 can be processed when the CA/R 10 is operating and is not jammed. Furthermore, in some embodiments, the medium transport path 32 is unidirectional. Furthermore, in some embodiments, when the CA/R 10 is operating normally, the medium transport path 32 is non-bypassable through the RFID station subsystem 22 and print station subsystem 24. In other embodiments, the CA/R 10 may include one or more bypass pathways along which medium can bypass one, or both of, the print station subsystem 24 and RFID station subsystem 22. Similarly, in other embodiments, the medium transport path 32, or portions of the medium transport path, may be reversible.

The print station subsystem 24 includes a print station protector subsystem 34. The print station subsystem 24 is configured to receive media, such as medium 12, traversing along the medium transport path 32. Media received at the print station subsystem 24 can be processed through the print station subsystem 24 with the print station subsystem 24 configured in one of at least two processing modes: "print offline" and "print online."

When the print station subsystem 24 is in print online mode, content is printed on the print surface 14 of the medium 12 as the medium 12 passes through the print station subsystem 24 along the medium transport path 32. The act of printing to the medium 12 results in wear and tear components of the print station subsystem 24, and some of the components may be expensive.

When the print station subsystem 24 is in print offline mode, it is desirable to protect components of the print station subsystem 24 from the normal wear and tear associated with the print station subsystem 24 receiving the medium 12. Typically, even when the print station subsystem 24 is not printing, print station subsystem 24 is subjected to wear and tear by the medium 12 traversing the print station subsystem 24. Thus, the print station protector subsystem 34 is configured to protect components such as a print head of the print station subsystem 24 when the print station subsystem 24 is in print offline mode.

In some embodiments, the control subsystem 20 may automatically configure the print station protector subsystem 34 to protect the print station subsystem 24 when the print station subsystem 24 is in print offline mode. Similarly, in some embodiments, a user may manually configure the print station protector subsystem 34 to protect the print station subsystem 24 when the print station subsystem 24 is switched to print offline mode and manually reconfigure the print station protector subsystem 34 when print station subsystem 24 is switched back to print online mode.

Among other things, the control subsystem 20 controls the print station subsystem 24 and the RFID station subsystem 22, and in some embodiments, the control subsystem 20 may be used to control the print station protector subsystem 34. In operation, the medium 12 is received by the CA/R 10, which then processes the medium 12 according to instructions received by the control subsystem 20. A user may provide processing instructions to the control subsystem 20 via a user-interface 36. Processing instructions may include instructions such as, but not limited to, "print only," "print and write only," "print and read only," "print, read and write," "read only," "read and process," and "write only." For the purposes of this specification, the RFID station subsystem 22 may "read" from and/or "write" to a memory of an RFID device such as the memory 18 of the RFID device 16 in the medium 12, and the print station subsystem 24 may "print" to a printable surface such as the print surface 14 of the medium 12.

When the CA/R 10 processes the medium 12 according to "print only" processing instructions, the print station subsystem 24 of the CA/R 10 prints to the print surface 14 of the medium 12, and the RFID station subsystem 22 of the CA/R 10 does not "read" or "write," or attempt to "read" or "write," to the memory 18 of the RFID device 16.

When the CA/R 10 processes the medium 12 according to "print and write only" processing instructions, the print station subsystem 24 of the CA/R 10 prints to the print surface 14 of the medium 12, and the RFID station subsystem 22 of the CA/R 10 writes to the memory 18 of the RFID device 16 in the medium 12. When the CA/R 10 processes the medium 12 according to "print and write only" processing instructions, the RFID station subsystem 22 does not "read", or attempt to "read", to the memory 18 of the RFID device 16.

When the CA/R 10 processes the medium 12 according to "print and read only" processing instructions, the print station subsystem 24 of the CA/R 10 prints to the print surface 14 of the medium 12, and the RFID station subsystem 22 of the CA/R 10 only reads from the memory 18 of the RFID device 16. When the CA/R 10 processes the medium 12 according to "print and read only" processing instructions, the RFID station subsystem 22 does not "write", or attempt to "write", to the memory 18 of the RFID device 16.

When the CA/R 10 processes the medium 12 according to "read only" processing instructions, the print station subsystem 24 of the CA/R 10 does not print, or attempt to print, to the print surface 14 of the medium 12, and the RFID station subsystem 22 of the CA/R 10 only reads from the memory 18 of the RFID device 16. When the CA/R 10 processes the medium 12 according to "read only" processing instructions, the RFID station subsystem 22 does not "write", or attempt to "write", to the memory 18 of the RFID device 16.

When the CA/R 10 processes the medium 12 according to "write only" processing instructions, the print station subsystem 24 of the CA/R 10 does not print, or attempt to print, to the print surface 14 of the medium 12, and the RFID station subsystem 22 of the CA/R 10 only writes to the memory 18 of RFID device 16. When the CA/R 10 processes the medium 12 according to "write only" processing instructions, the RFID station subsystem 22 does not "read", or attempt to "read", to the memory 18 of RFID device 16.

In some embodiments, the control subsystem 20 may be in communication with other devices such as print controllers or computers or the like via a network interface such as a network interface card (NIC) 38. The control subsystem 20 may receive processing instructions from these devices (print controllers, computers, etc.) and processes received media accordingly.

In some situations, the control subsystem 20 may also receive processing instructions from the RFID device 16 of the medium 12. For example, a user might have set the CA/R 10 to operate in the "read and process" mode. In the "read and process" mode, the RFID station subsystem 22 reads information from memory 18 of the RFID device 16, which is then provided to the control subsystem 20. The information from the RFID device 16 may include processing instructions, and in that case, the control subsystem 20 may process the medium 12 according to the processing instructions. For example, the information from the memory 18 might indicate that content is to be printed on the print surface 14, and the information might also indicate where the content can be located, or the memory 18 of the RFID device 16 might provide the content. As another example, the instructions from the memory 18 might indicate that the print surface 14 should not be printed upon. Similarly, the instructions might indicate information should not be written to the memory 18, or that the memory 18 may receive information.

In some embodiments, the RFID station subsystem 22 may be configured to automatically interrogate the medium 12 looking for an RFID device 16. Assuming that the memory 18 of the RFID device 16 carries processing instructions, the CA/R 10 may be configured to automatically respond to the processing instructions stored in the memory 18 of the RFID device 16.

In some situations, it may be desired that the print station subsystem 24 does not print content on the print surface 14 of the medium 12 such as when the CA/R 10 is operating in "read only" mode. For example, in some situations, a user might desire to find out what information, if any, is written into the memory 18 of the RFID device 16, but the user might not want to have content printed on the print surface 14 of the medium 12. In that case, the user might set the CA/R 10 into "read only" processing mode, and the control subsystem 20 may switch the print station subsystem 24 to "print offline" mode. The ability to switch the print station subsystem 24 between "print offline" mode and "print online" mode allows the CA/R 10 to employ a single medium transport path, such as medium transport path 32, regardless of whether the medium 12 should be printed on or not. In other words, there is no need to provide a bypass path of the print station subsystem 24 when it is desired not to print on the medium 12.

It should be noted that the CA/R 10 might also include an input tray (not shown) and a feeder (not shown). The input tray and the feeder may be used to feed multiple units of medium 12 into the CA/R 10.

Furthermore, it should be noted that in some embodiments, the RFID station subsystem 22 and the print station subsystem 24 might be arranged such that the print station subsystem 24 is proximal to the input side 28 and the RFID station subsystem 22 is proximal to the output side 30. In this configuration, the print station subsystem 24 might receive the medium 12 before the RFID station subsystem 22 receives the medium 12.

Figure 2:
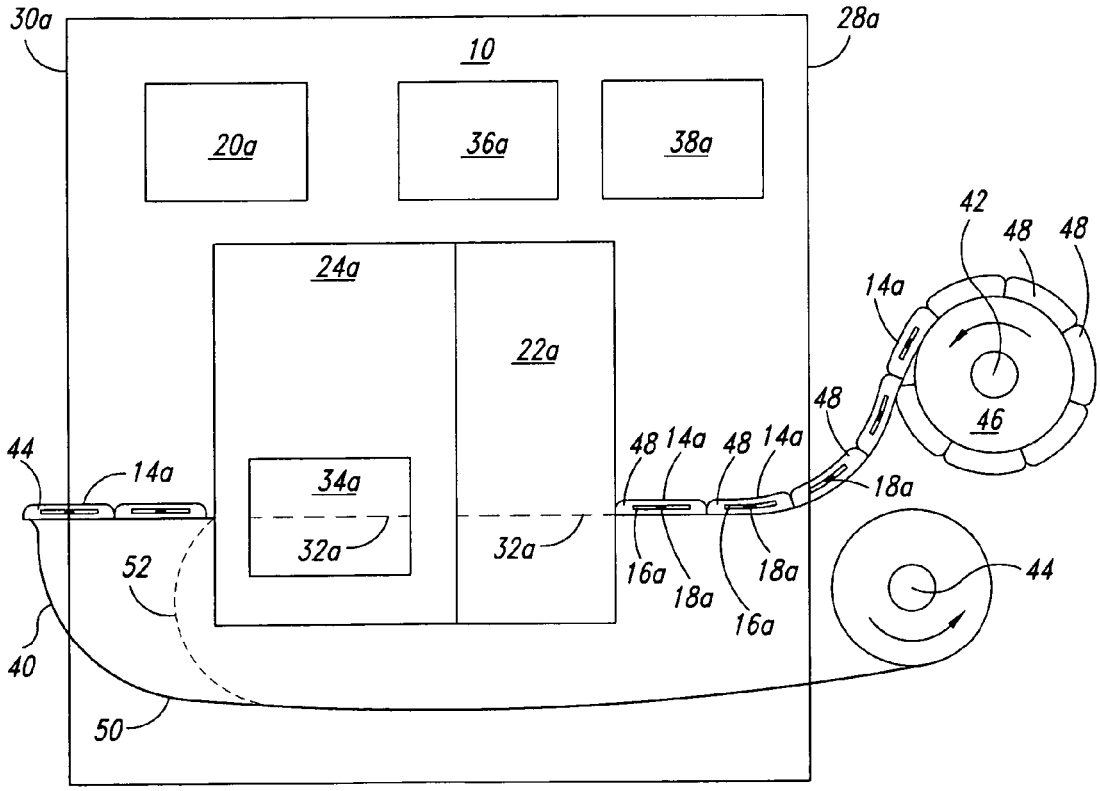
FIG. 2 is a functional block diagram of a content applicator and reader according to a second illustrated embodiment.

FIG. 2 shows another embodiment of the CA/R 10 according to a second illustrated embodiment. In FIG. 2, the various labels having a both a reference numeral and a letter "a" identify similar components and/or features as those of FIG. 1 that are labeled with the same reference numeral. (For example, the labels "18" and "18*a*" are used to identify the control subsystem in FIG. 1 and FIG. 2, respectively.) The detailed description of such components are initially provided with respect to the embodiment of FIG. 1 and for the sake of brevity the description of such components in the context of their subsequently a-labeled counterparts in FIG. 2 are abbreviated or omitted.

In the embodiment illustrated in FIG. 2, the CA/R 10 does not include the medium transport assembly 26. In this embodiment, the RFID station subsystem 22*a* and the print station subsystem 24*a* are illustrated as abutting such that the portion of the medium transport path 32*a* through the RFID station subsystem 22*a* is aligned with the portion of the medium transport path 32*a* through the print station subsystem 24*a*. This illustration is provided merely for the sake of clarity. In some embodiments, the RFID station subsystem 22*a* and the print station subsystem 24*a* might not abut, or the portion of the medium transport path 32*a* through the RFID station subsystem 22*a* might not be aligned with the portion of the medium transport path 32*a* through the print station subsystem 24*a*. Typically, the RFID station subsystem 22*a* and the print station subsystem 24*a* are positioned such that the print station subsystem 24*a* may receive media, such as, but not limited to, medium 12 (and/or labels 48), from the RFID station subsystem 22*a*.

In the embodiment illustrated in FIG. 2, the CA/R 10 includes a label peeler 40, an unwind spindle 42, and a rewind spindle 44. The label peeler 40 is disposed on the output side 30*a* of the CA/R 10, and the spindles 42 and 44 are disposed proximal to the input side 28*a* of the CA/R 10. Disposed on the unwind spindle 42 is a label roll 46.

The label roll 46 is comprised of a number of labels 48 carried by a release liner 50. Normally, each one of the labels 48 includes an RFID device 16*a* and a print surface 14*a*. It should be noted that in some embodiments, the labels 48 may not include the RFID devices 16*a*, and in other embodiments, the labels 48 may not have a printable surface. Furthermore, in some embodiments, the label roll 46 may include various combinations of labels, some with, or without, RFID devices 16*a* and some with, or without, print surfaces 14*a*.

In operation, the CA/R 10 may process the label roll 46 in either label-peel mode or label-rewind mode. FIG. 2 illustrates the CA/R 10 in label-peel mode operation. A portion of the label roll 46 is feed through the CA/R 10 along the medium transport path 32*a* and out over the label peeler 40. The release liner 50 is feed back underneath the label peeler 40 and through the CA/R 10 to the rewind spindle 44 where the release liner 50 is rewound. The labels 48 are separated from the release liner 50 as the release liner 50 is pulled back underneath the label peeler 40.

In label-rewind mode, the labels 48 are not peeled from the release liner 50. Instead, after a given label 48 has exited the print station subsystem 24, the release liner 50 (with the given label 48 still thereon) is rewound on the rewind spindle 44. In one embodiment, a portion of the label roll 46 is feed along a label peeler bypass path 52 when the CA/R 10 is operating in rewind mode. Consequently, seeing as how the labels 48 bypass the label peeler 40, the labels 48 are not separated from the release liner 50. In another embodiment, the label peeler 40 may be removed from the output side 30*a*, or otherwise disabled, such that the labels 48 are not peeled from the release liner 50 when the CA/R 10 is operating in label-rewind mode.

Figure 3:
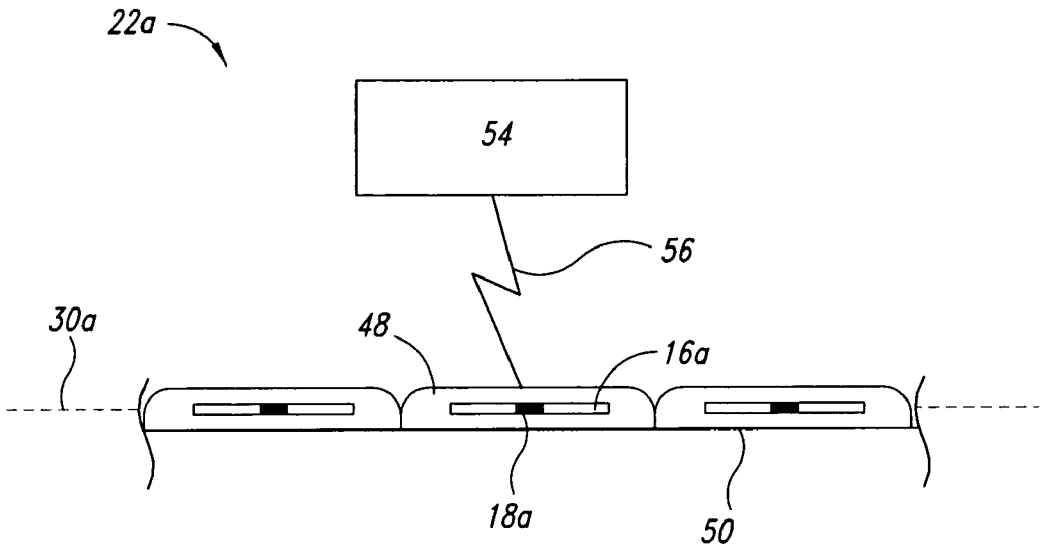
FIG. 3 is a functional block diagram of an RFID reader/writer of FIG. 2 according to one illustrated embodiment.

FIG. 3 shows an embodiment of the RFID station subsystem 22*a* according to one illustrated embodiment. In FIGS. 2 and 3, similar components and/or features are labeled with the same reference numeral or the same reference number and letter.

In the embodiment illustrated in FIG. 2, the RFID station subsystem 22*a* includes an RFID antenna 54, which is used for establishing a communication link 56 with RFID devices such as RFID devices 16*a*. The RFID antenna 54 can be used to "write" content into the memory 18*a* of RFID device 16*a* or to "read" content from memory 18*a* the RFID device 16*a*, or for both "read" and "write."

Figure 4A:
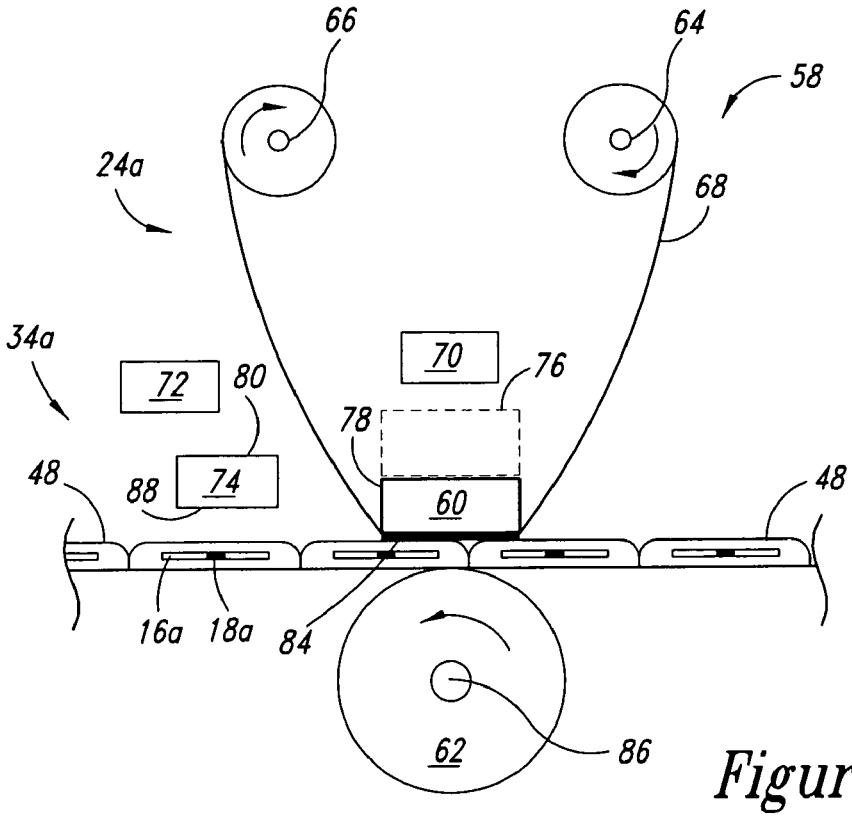
FIG. 4A is a functional block diagram of a print station subsystem in print online mode and a print station protector subsystem of FIG. 2 according to one illustrated embodiment.
Figure 4B:
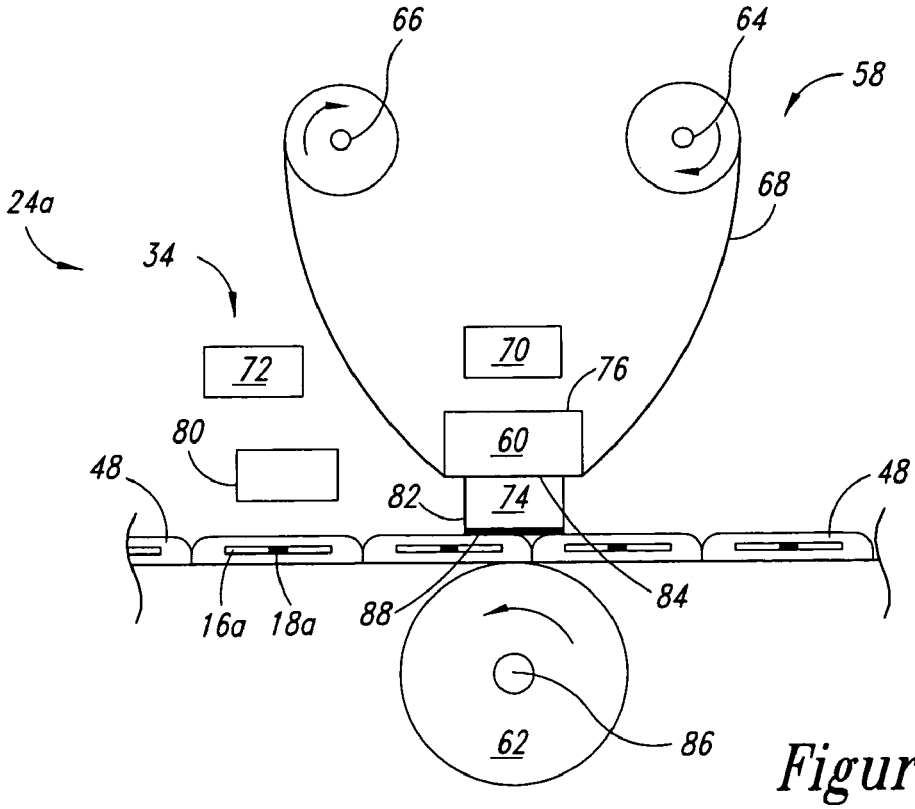
FIG. 4B is a functional block diagram of a print station subsystem in print offline mode and a print station protector subsystem of FIG. 2 according to one illustrated embodiment.

FIG. 4A shows an embodiment of the print station subsystem 24*a* in print online mode according to one illustrated embodiment, and FIG. 4B shows an embodiment of the print station subsystem 24*a* in print offline mode according to one illustrated embodiment. In FIG. 4A, components and/or features having the same label identify similar components and/or features as those of FIG. 4B, and vice-versa. For the sake of brevity the description of such components will be provided once. In addition, in FIGS. 2, 4A and 4*b*, similar components and/or features are labeled with the same reference numeral or the same reference number and letter.

Referring to both FIGS. 4A and 4B, the print station subsystem 24*a* includes the print station protector subsystem 34 and a printer assembly 58. The printer assembly 58 includes a thermal print head 60, a platen 62, a pair of ribbon spindles 64 and 66 for receiving a ribbon 68 such as a thermal transfer ribbon. In the following discussion, the platen 62 is described as a platen roller. In other embodiments, the platen 62 might be a non-rotating platen such as, but not limited to, a flat or planar platen, or a platen having a curved surface.

In the following discussion, the thermal print head 60 is described as a thermal print head, but this is merely for the sake of clarity is not intended to be limiting. In other embodiments, the thermal print head 60 might be, among others, a laser print head or an ink-jet print head. Similarly, for the sake of clarity, the ribbon 68 is described as a thermal transfer ribbon.

Referring to both FIGS. 4A and 4B, the print station protector subsystem 34 includes a print head driver 70, a protective member driver 72, and a protective member 74. The print head driver 70 is configured to move the thermal print head 60 between a print head offline-position 76 (see FIG. 4A) and a print head online-position 78 (see FIG. 4A). The protective member driver 72 is configured to move the protective member 74 between a protective member waiting station 80 and a protective member operational position 82. In FIG. 4A, the thermal print head 60 is located at the print head online-position 78, and the protective member 74 is located at the protective member waiting station 80. In FIG. 4B, the thermal print head 60 is located at the print head offline-position 76, and the protective member 74 is located at the protective member operation-position 82.

Referring to FIG. 4A, in print online mode, the thermal print head 60 is proximal to the platen roller 62. In print online mode, the ribbon 68 extends from the unwind spindle 64 underneath a bottom surface 84 of the thermal print head 60 and up to the rewind spindle 66. In the embodiment illustrated in FIG. 4B, in print offline mode, the ribbon 68 may extend between the unwind spindle 64 underneath the bottom surface 84 of the thermal print head 60 and up to the rewind spindle 66. However, in other embodiments, the ribbon 68 may be removed from the spindles 64 and 66 when the print station subsystem 24*a* is in print offline mode. In other embodiments, when the print station subsystem 24*a* is in print offline mode, the ribbon 68 may be rewound on the unwind spindle 64 and then rethreaded when the print station subsystem 24*a* is switched to print online mode.

In operation, when the print station subsystem 24*a* is in print online mode, the platen roller 62 rotates about a rotational axis 86. In print label online mode, the thermal print head 60 and the platen roller 62 are arranged such that a gap extends between the bottom surface 84 of the thermal print head 60 and the platen roller 62. The gap is of sufficient size for receiving the labels 48 of the label roll 46. The thermal print head 60 and the platen roller 62 are disposed such that the bottom surface 84 of the thermal print head 60, or a portion of the bottom surface 84, or the ribbon 68 presses the labels 48 of the label roll 46 against the platen roller 62, and the rotation of the platen roller 62 about the rotation axis 86 causes the labels 48 of the label roll 46 to be fed through the print station subsystem 24*a* along the medium transport path 32*a*.

In print label offline mode, the protective member 74 is disposed such that a bottom surface 88 of the protective member 74 is proximal to the platen roller 62. A gap of sufficient size for receiving the labels 48 of the label roll 46 extends between the bottom surface 88 of the protective member 74 to the platen roller 62. The protective member 74 and the platen roller 62 are disposed such that the bottom surface 88 of the protective member 74, or a portion of the bottom surface 88, presses the labels 48 of the label roll 46 against the platen roller 62, and the rotation of the platen roller 62 about the rotation axis 86 causes the labels 48 of the label roll 46 to be fed through the print station subsystem 24*a* along the medium transport path 32*a*. The protective member 74 is made using materials that are effective in protecting the bottom surface 84 of the thermal print head 60 and that are suitable for withstanding the wear caused by the passage of the labels 48 against the protective member 74. Non-limiting examples of materials that may be used for the protective member 74 include plastic and metal. In some embodiments, the protective member 74 covers the bottom surface 84 of the thermal print head 60.

When the print station subsystem 24*a* is switched from print offline mode to print online mode, the protective member driver 72 moves the protective member 74 from the protective member operational position 82 to the waiting station 80, and the print head driver 70 moves the thermal print head 60 from the print head offline position 76 to the print head online position 78.

When the print station subsystem 24*a* is switched from print online mode to print offline mode, the protective member driver 72 moves the protective member 74 from the waiting station 80 to the protective member operational position 82, and the print head driver 70 moves the thermal print head 60 from the print head online position 78 to the print head offline position 76.

In the embodiment illustrated in FIGS. 4A and 4B, the control subsystem 20 includes logic for, among other things, controlling the thermal print head 60, the print head driver 70, and the protective member driver 72. Among other things, the control subsystem 20 can use the print head driver 70 and the protective member driver 72 to switch the print station subsystem 24*a* between print online mode and print offline mode. The control subsystem 20 can also turn the thermal print head 60 on and off and/or to and from stand-by mode.

As a non-limiting example, the control subsystem 20 might switch the thermal print head to stand-by mode by reducing electrical power to the thermal print head such that the temperature of the thermal print head becomes less than the operational temperature for the thermal print head. The control subsystem 20 could switch the thermal print head out of stand-by mode by increasing the electrical power to the thermal print head.

In the embodiment illustrated in FIGS. 4A and 4B, the ribbon 68 extends beneath the bottom surface 84 of the thermal print head 60 when the print station subsystem 24*a* is in both print offline mode and print online mode. However, in some embodiments, the control subsystem 20 may also control the ribbon 68 such that when the print station subsystem 24*a* is switched to print offline mode, the ribbon 68 is moved so that the ribbon 68 does not extend underneath the bottom surface 84 of the thermal print head 60. When the print station subsystem 24*a* is switched back to print online mode, the control subsystem 20 may also move the ribbon 68 such that the ribbon 68 extends underneath the bottom surface 84 of the thermal print head 60.

In some embodiments, the print station subsystem 24*a* and the print station protector subsystem 34*a* might be configured to allow a user to switch the print station subsystem 24*a* between print online mode and print offline mode. In that case, the user might move the thermal print head 60 between the print head offline position 76 and the print head online position 78, and the user might move the protective member to and from the protective member operational position 82.

In some embodiments, when a user switches the print station subsystem 24*a* to print offline mode, the user might manually move the thermal print head 60 to the print offline position 76 and manually attach the protective member 74 to the thermal print head 60. The protective member 74 might be a cap that covers the bottom surface 84 of the thermal print head 60. The protective member 74 might also (fully or partially) cover other surfaces of the thermal print head 60. In some embodiments, the protective member is configured to mate with the thermal print head 60 and might be configured to snap fit onto the thermal print head 60. Alternatively, the protective member 74 and the thermal print head 60 might be configured to mate using alignment structure, for example, aligned projections and receiving holes. For instance, the protective member 74 may have the projections that extend outward, and the thermal print head 60 may have the receiving holes. When the protective member 74 is properly aligned with the thermal print head 60, the projections are aligned with the receiving holes. The protective member 74 is coupled to the thermal print head 60 by the projections extending into the receiving holes. In yet another embodiment, the protective member 74 and the thermal print head 60 may be coupled by mating ribs and grooves that are configured to enable the protective member 74 to be slidably coupled to the thermal print head 60. In yet another embodiment, the protective member 74 may be removably coupled to the thermal print head 60 via a fastener such as, but not limited to, a snap, a clip, a thumbscrew, etc.

In some embodiments, moving the thermal print head 60 to the print offline position 76 may reduce the pressure between the thermal print head 60 and the platen 62.

Figure 5:
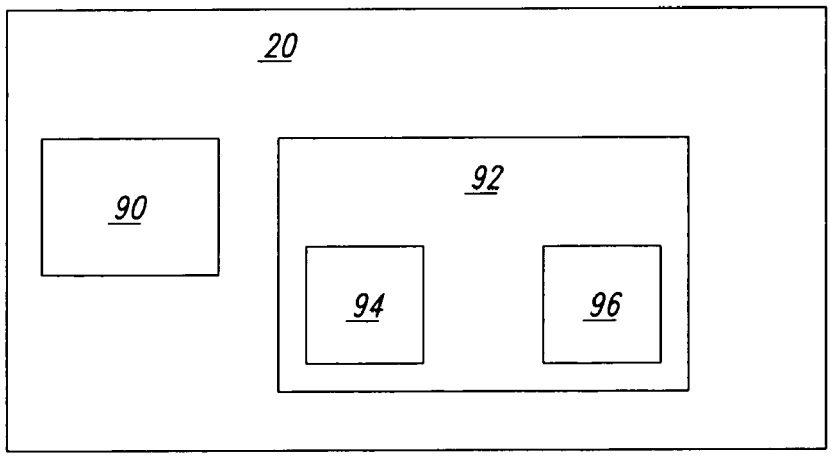
FIG. 5 is a functional block diagram of a control subsystem of FIG. 1 according to one illustrated embodiment.

FIG. 5 shows the control subsystem 20 of the CA/R according to an illustrated embodiment. The control subsystem 20 includes a processor 90 and a memory 92. The memory 92 includes a user-interface module 94 and a print station protection module 96. The user-interface module 94 includes logic for, among other things, providing the user-interface 36, e.g., to the CA/R 10, enabling user input and providing output to a user.

The print station protection module 96 includes logic for, among other things, protecting the thermal print head 60 when the print station subsystem 24*a* is in print offline mode. The print station protection module 96 may also include logic for, among other things, switching between print offline mode and print online mode. Among other things, the print station protection module 96 may protect the thermal print head 60 from wear by actuating the print head driver 70, which results in the thermal print head 60 being moved upward, away from the medium transport path 32*a* when the CA/R 10 is in print offline mode. The print station protection module 96 may also actuate the protective member driver 72, thereby causing the protective member 74 to be placed in protective member operational position 82, e.g., between the thermal print head 60 and the platen roller 62. The print station protection module 96 may also include logic for, among other things, reducing electrical power to the thermal print head 60 so as to reduce or eliminate thermal heat for printing when the print station subsystem 24 is in print offline mode.

The print station protection module 96 may also include logic for enabling the thermal print head 60 to be returned to print head online position 78 when the print station subsystem 24 is in print online mode. Similarly, the print station protection module 96 can move the protective member 74 into the protective member waiting station 82 when the print station subsystem 24 is in print offline mode.

Figure 6A:
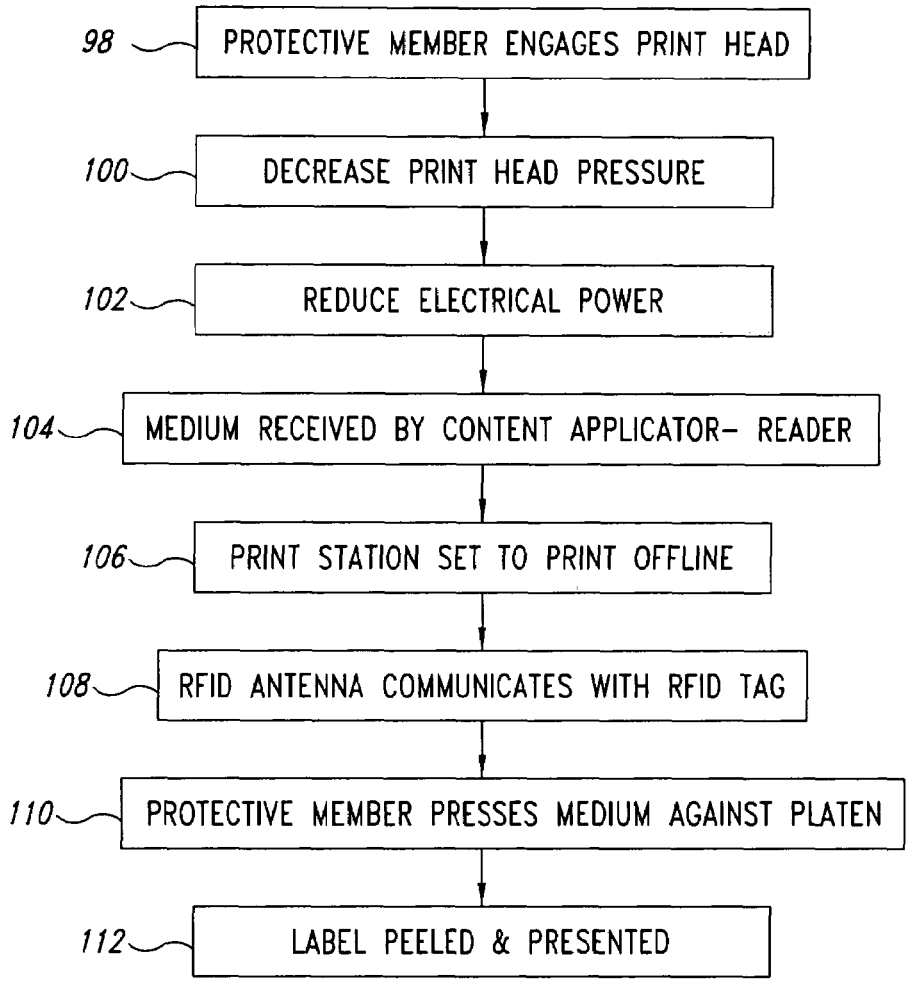
FIG. 6A is a flow diagram showing a method of operating a content applicator and reader according to one illustrated embodiment.
Figure 6B:
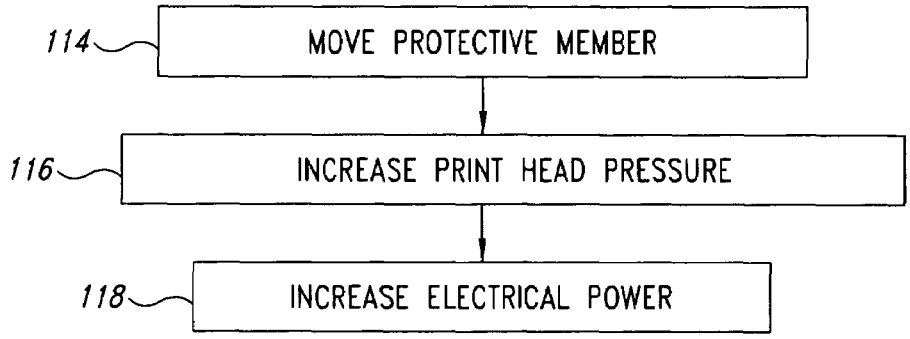
FIG. 6B is a flow diagram showing a method of switching a content applicator and reader to print online mode according to one illustrated embodiment.

FIG. 6A illustrates a method of processing a label roll and protecting the thermal print head 60 according to one illustrated embodiment.

At 98, the protective member 74 engages the thermal print head 60. The protective member 74 can be manually inserted between the thermal print head 60 and the platen roller 62. Alternatively, the protective member 74 may be attached to the thermal print head 60.

At 100, the pressure between the thermal print head 60 and the platen roller 62 is reduced. In some embodiments, the control subsystem 20 decreases the pressure between the thermal print head 60 and the platen roller 62, and in other embodiments, the pressure may be reduced by a user manually moving the thermal print head 60 away from the print head online-position 78.

At 102, the electrical power to the thermal print head 60 is reduced. By reducing the electrical power to the thermal print head 60, the thermal print head 60 may be placed in a stand-by mode such that the temperature of the thermal print head in stand-by mode is not the operational temperature for the thermal print head.

At 104, a portion of the label roll 46 is fed through to CA/R 10. The labels 48 in the label roll 46 may include RFID devices 16.

At 106, the print station subsystem 24 is set to print offline mode.

At 108, the RFID station subsystem 22 communicates with the RFID device 16 in one of the labels 48.

At 110 the protective member 74 presses the labels 48 against the platen roller 62, and the rotation of the platen roller 62 pulls the labels 48 through CA/R 10.

At 112, the label 48 is peeled from the release liner 50 and presented, and the processing has been completed.

FIG. 6A illustrates a method of switching the CA/R 10 to print online mode according to one illustrated embodiment.

At 114, the protective member 74 moved from the protective member operational position 82. In some embodiments, the protective member 74 is uncoupled from the thermal print head 60, and, in some embodiments, a user might manually uncouple the protective member 74 from the thermal print head 60.

At 116, the pressure between the thermal print head 60 and the platen roller 62 is increased.

At 118, the electrical power to the thermal print head 60 is increased. By increasing the electrical power to the thermal print head 60, the thermal print head 60 may be switched out of stand-by mode such that the temperature of the thermal print head 60 is returned to the operational temperature for the thermal print head 60.

Figure 7:
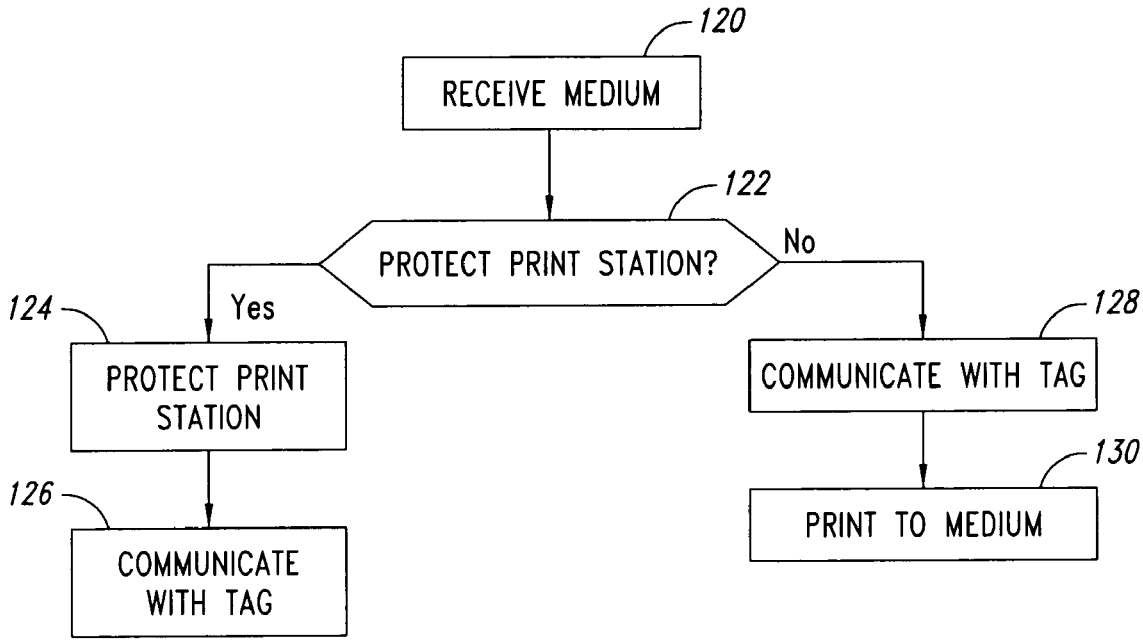
FIG. 7 is a flow diagram showing a method of operating a content applicator and reader according to a second illustrated embodiment.

FIG. 7 shows another method of processing a medium and protecting the print station subsystem 24 according to one illustrated embodiment.

At 120, the CA/R 10 receives a medium.

At 122, a decision of whether to protect the components of the print station subsystem 24 is made. In some embodiments, the decision may be made by a user. The user may provide user input instructing the CA/R 10 to protect the print station subsystem 24. For example, the user may select to put the CA/R 10 into read only mode such that the CA/R 10 reads RFID devices and does not print content onto labels 48 using the thermal print head 60. In some embodiments, the decision to protect the print station subsystem 24 may be made by the control subsystem 20. For example, the control subsystem 20 may use the RFID antenna 54 to interrogate the RFID device 16. Based upon the information conveyed from the interrogation of the RFID device 16, the control subsystem 20 may decide that the print station subsystem 24 is to be protected because the thermal print head 60 will not be used for processing the medium. In some embodiments, the control subsystem 20 may cause the RFID antenna 54 to attempt to interrogate a RFID device. If a medium does not include a RFID device, then the control subsystem 20 may determine that the medium is for printing on and in that case, the decision is made not to protect the print head.

If the decision at 122 is to protect the print station subsystem 24, then the process proceeds to 124, where the print station subsystem is protected. The print station subsystem may be protected by, among other things: reducing the pressure between the thermal print head 60 and the platen roll 62; by reducing the electrical power to the thermal print head such that the temperature of the thermal print head is not the operational temperature; by moving the thermal print head 60 such that the thermal print head 60 does not engage the medium 12 (or labels 48) passing through the print station subsystem 24; and/or by interposing a protective member 74 between the thermal print head 60 and the medium 12 (or labels 48) passing through the print station subsystem 24.

At 126, communication with the RFID device 16 of the medium is established. The communication might be to read from the memory 18 of the RFID device 16, or to write to the memory 18, or to both read and write to the memory 18.

If, on the other hand, the decision at 122 is not to protect the print station subsystem 24, then the process continues at 128. At 128, communication with the RFID device 16 of the medium is established. The communication might be to read from the memory 18 of the RFID device 16, or to write to the memory 18, or to both read and write to the memory 18.

At 130, content is printed on the print surface 14 of the medium, and the process ends at 138.

All of the above U.S. patents, U.S. patent application publications, U.S. patent applications including but not limited to U.S. Provisional Patent Application No. 60/723,168, filed Oct. 3, 2005, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A content applicator comprising:

a thermal ribbon print head; and a protective member selectively interposable between the thermal ribbon print head and a media transport path for media processed by the content applicator.

2. The content applicator of claim 1, wherein the protective member is selectively coupleable to the thermal ribbon print head and engages media in the media transport path.

3. The content applicator of claim 1, further comprising:

a platen opposed to the thermal ribbon print head, wherein the media transport path extends between the platen and the thermal ribbon print head.

4. The content applicator of claim 3, wherein the protective member and the platen engage media as the media moves along the media transport path.

5. The content applicator of claim 1, wherein the thermal ribbon print head has a at least one resistive surface, and wherein the protective member covers at least a portion of the at least one resistive surface of the thermal ribbon print head such that media in the media transport path do not engage the covered portion of the thermal ribbon print head.

6. The content applicator of claim 1, wherein the thermal ribbon print head is movable between a position proximate to the media transport path and a position spaced therefrom.

7. The content applicator of claim 1, further comprising:

an RFID antenna for communicating with an RFID device of a medium in the media transport path.

8. The content applicator of claim 1, wherein the protective member is removably affixed to the thermal ribbon print head.

9. The content applicator of claim 1, wherein the platen is a roller.

10. A method of using a content applicator, the method comprising:

receiving a medium at a content applicator having a print station with a thermal ribbon print head;

interposing a protective member between the thermal ribbon print head and a media transport path;

feeding the medium through the print station; and writing to at least one radio frequency identification device carried by the medium.

11. The method of claim 10, wherein interposing the protective member between the thermal ribbon print head and the media transport path includes removably coupling the protective member to the thermal ribbon print head.

12. The method of claim 10, wherein protecting the thermal ribbon print head further includes switching the thermal ribbon print head from operational mode to inoperational mode.

13. The method of claim 12, wherein switching the thermal ribbon print head to inoperational mode includes at least one of reducing a pressure exerted between the thermal ribbon print head and a platen, and reducing electrical power provided to the thermal ribbon print head.

14. The method of claim 13, further comprising:

selectively removing the protective member from interposition between the print head and the media transport path; and at least one of, increasing the pressure exerted between the thermal ribbon print head and the platen or increasing electrical power provided to the thermal ribbon print head.

15. A content applicator comprising:

a print station including a thermal ribbon print head having at least one resistive element, and a platen opposed across a media transport path from the at least one resistive element, the print station configured to be switched between a print station online mode and a print station offline mode; and a print station protector selectively positionable with respect to the thermal ribbon print head to protect the at least one resistive element of the print station from degradation cause by the print station receiving a medium when the print station is in the print station offline mode.

16. The content applicator of claim 15, further comprising:

an actuator operable to selectively position the at least one resistive element proximate to the transport path in the print station online mode and to position the at least one resistive element distally from the media transport path in the print station offline mode.

17. The content applicator of claim 16, wherein the print station protector includes a protective member selectively positionable between at least a portion of the thermal ribbon print head and at least a portion of the media transport path.

18. The content applicator of claim 15, further comprising:

a control subsystem that switches the print station between print offline mode and print online mode.

19. The content applicator of claim 15, further comprising:

an RFID antenna configured to communicate an RFID device disposed in a medium received by the content applicator.

20. The content applicator of claim 15, further comprising:

an actuator operable to selectively increase pressure exerted between the thermal ribbon print head and a platen in response to the print station being switched from print station offline mode to print station online mode and operable to selectively decrease pressure exerted between the thermal ribbon print head and the platen in response to the print station being switched from print station online mode to print station offline mode.

* * * * *